US008777060B2

(12) United States Patent
Hesketh et al.

(10) Patent No.: US 8,777,060 B2
(45) Date of Patent: Jul. 15, 2014

(54) DISCHARGER FOR SIDE-SECURED BAG SPOUT

(75) Inventors: David Francis Hesketh, Fort Mill, SC (US); Jeffrey Allen Dudas, Waxhaw, NC (US)

(73) Assignee: Spiroflow Systems, Inc., Monroe, NC (US)

( * ) Notice: Subject to any disclaimer, the term of this patent is extended or adjusted under 35 U.S.C. 154(b) by 10 days.

(21) Appl. No.: 13/351,027

(22) Filed: Jan. 16, 2012

(65) Prior Publication Data

US 2013/0181007 A1 Jul. 18, 2013

(51) Int. Cl.
*B65D 35/24* (2006.01)

(52) U.S. Cl.
USPC ..... 222/105; 222/567; 29/428

(58) Field of Classification Search
USPC ..... 222/180, 181.1, 181.2, 181.3, 567, 95, 222/105, 559, 504, 505, 527, 528, 202, 222/530; 29/428; 383/67; 53/381.1, 384.1, 53/468
See application file for complete search history.

(56) References Cited

U.S. PATENT DOCUMENTS

| | | | | | |
|---|---|---|---|---|---|
| 2,894,666 | A * | 7/1959 | Campbell, Jr. | ..... | 222/528 |
| 2,954,901 | A * | 10/1960 | Winstead | ..... | 222/183 |
| 3,961,655 | A * | 6/1976 | Nattrass et al. | ..... | 383/24 |
| 4,365,737 | A * | 12/1982 | Marvia | ..... | 229/122 |
| 4,691,371 | A * | 9/1987 | Derby | ..... | 383/62 |
| 4,767,035 | A * | 8/1988 | Jacobi | ..... | 222/527 |
| 4,769,972 | A * | 9/1988 | West | ..... | 53/415 |
| 4,817,824 | A * | 4/1989 | LaFleur et al. | ..... | 222/105 |
| 5,340,218 | A * | 8/1994 | Cuthbertson | ..... | 383/67 |
| 5,417,039 | A * | 5/1995 | Hansson et al. | ..... | 53/449 |
| 5,442,898 | A * | 8/1995 | Gabree et al. | ..... | 53/459 |
| 5,475,966 | A * | 12/1995 | Renfrow | ..... | 53/381.1 |
| 5,484,207 | A * | 1/1996 | Schnaars et al. | ..... | 383/67 |
| 5,588,279 | A * | 12/1996 | Runnberg et al. | ..... | 53/426 |
| 5,664,406 | A * | 9/1997 | Smith | ..... | 53/459 |
| 5,685,454 | A * | 11/1997 | Bonerb | ..... | 222/1 |
| 5,687,881 | A * | 11/1997 | Rouse et al. | ..... | 222/185.1 |
| 5,715,648 | A * | 2/1998 | Yates | ..... | 53/381.5 |
| 6,186,360 | B1 * | 2/2001 | Becker et al. | ..... | 222/1 |
| 6,318,594 | B1 * | 11/2001 | Hutchins | ..... | 222/1 |
| 6,431,753 | B1 * | 8/2002 | Rogers et al. | ..... | 383/41 |
| 7,013,625 | B2 * | 3/2006 | Curles | ..... | 53/571 |
| 7,159,744 | B2 * | 1/2007 | Sterner et al. | ..... | 222/202 |
| 7,303,090 | B2 * | 12/2007 | Nanjo et al. | ..... | 220/360 |
| 7,552,837 | B2 * | 6/2009 | Nanjo et al. | ..... | 220/360 |
| 7,568,328 | B2 * | 8/2009 | Imao | ..... | 53/570 |
| 8,371,476 | B2 * | 2/2013 | Weissbrod | ..... | 222/105 |
| 2004/0206780 | A1 * | 10/2004 | Sterner et al. | ..... | 222/202 |
| 2005/0194406 | A1 * | 9/2005 | Kosich | ..... | 222/181.1 |

* cited by examiner

*Primary Examiner* — Paul R Durand
*Assistant Examiner* — Donnell Long
(74) *Attorney, Agent, or Firm* — Shumaker, Loop & Kendrick, LLP

(57) ABSTRACT

A bag spout retainer apparatus for a bulk bag discharger is the disclosure of the type wherein a frame suspends a bulk bag with a side-secured discharge spout, and the spout is held in a closed position against the bag. A bag-engaging member is mounted on the frame in a position laterally-displaced from a lower end of the bag above the discharge spout. A reciprocating driver is attached to the bag-engaging member and is adapted for moving the bag-engaging member between a retracted position out of engagement with the lower end of the bag and an extended bag engaging position for engaging and holding the bag spout in a closed position against the side of the bag during release of the spout against the side of the bag.

7 Claims, 6 Drawing Sheets

DISCHARGER FOR SIDE-SECURED BAG SPOUT

TECHNICAL FIELD AND BACKGROUND OF THE INVENTION

This application relates to a discharger for bulk bags of the type that have a bottom spout that is tied into a closed position to the side of the bulk bag. Bulk bags of the type that are the subject of this invention are generally large, robustly constructed bags used to contain and transport powders and other granular materials, which, depending on size, may be referred to as bulk or semi-bulk bags. These bags, which may be capable of holding a ton or more of contents, are normally transported by a fork lift overhead crane, chain hoist or lifting frame due to their size and weight. The bags are typically suspended in a frame by lifting straps. The frame resides over a receptacle, such as a hopper, into which the contents are allowed to flow by gravity. The bags are provided with an elongate discharge spout positioned in the bottom of the bag that is normally tied off with tie strings during storage and transport. When the contents are to be emptied, the bag, suspended in its frame, is opened by loosening the tie strings so that the weight of the bag contents pushes open the discharge spout, allowing the contents to flow downwardly from the bag, through the discharge spout and into the receptacle over which it is suspended.

There are two principal types of discharge spout closing techniques. One common technique utilizes tie strings to pinch off the spout in a manner similar to closing a drawstring purse. Another technique, and the one to which this application relates, utilizes a discharge spout that is folded from its open position upwardly to the side and into contact with the side of the bag near the bag bottom. See FIGS. 1 and 2. The spout, which forms a flap, is tied into its closed position with tie strings that attach to a side of the bag. The spout functions as a closure flap and is held against the side of the bag until released. Because of the weight of the contents, when the tie strings are released the spout will be forced down into a vertical discharge position allowing the spout to open and the bag contents to rapidly flow from the spout. The contents can quickly become entrained in the air in the vicinity of the human operators and be inhaled.

Therefore it is desirable to provide a means of allowing the human operator to release the tie strings on a bulk bag of the type having a bottom flap and move away from the vicinity of the bag before the contents begin flowing through the spout in order to prevent operator exposure to the bag contents.

SUMMARY OF THE INVENTION

Therefore, it is an object of the invention to provide a means of maintaining the folded spout of a bulk bag in a closed position after tie strings are released preparatory to discharging contents from the bag.

It is another object of the invention to provide a means of maintaining the folded spout of a bulk bag in a closed position after tie strings are released in order to provide time for a human operator to move away from the vicinity of the bag opening before the contents begin flowing from the bag.

These and other objects and advantages are achieved by providing a bag spout retainer apparatus for a bulk bag discharger of the type wherein a frame suspends a bulk bag with a side-secured discharge spout and a tie is attached to the side of the bag that holds the spout in its closed position. A bag-engaging member is mounted on the frame in a position laterally-displaced from a lower end of the bag above the discharge spout, and a reciprocating driver is attached to the bag-engaging member adapted for and moving the bag-engaging member between a retracted position out of engagement with the lower end of the bag and an extended bag engaging position for engaging and holding the bag spout in a closed position against the side of the bag during release of the tie from its position around the spout.

According to one embodiment of the invention, the bag-engaging member is a paddle.

According to another embodiment of the invention, the bag-engaging member comprises a paddle pivotally mounted on the frame, and the driver comprises a pneumatic cylinder.

According to another embodiment of the invention, the pneumatic cylinder includes a cylinder rod having a connecting pin on a distal end thereof mounted in an elongate slot in the paddle and oriented to move the paddle upwardly and inwardly into contact with the bag and outwardly and downwardly away from the bag.

According to another embodiment of the invention, a bag spout retainer apparatus is disclosed for a bulk bag discharger of the type wherein a frame suspends a bulk bag with a side-secured discharge spout, and a tie is attached to the side of the bag and holds the spout in its closed position. A bag-engaging paddle is pivotally mounted on the frame in a position laterally-displaced from a lower end of the bag above the discharge spout. A reciprocating power cylinder is carried by the frame, and is attached to the bag-engaging paddle and adapted for moving the bag-engaging paddle between a retracted position out of engagement with the lower end of the bag and an extended bag engaging position for engaging and holding the bag spout in a closed position against the side of the bag before and during release of the tie from its position holding the spout in its closed position. The power cylinder includes a connecting pin mounted in an elongate slot in the paddle that is oriented to move the paddle upwardly and inwardly into contact with the bag and outwardly and downwardly away from the bag.

According to another embodiment of the invention, the paddle includes a pivoting paddle plate mounted on a paddle bracket, and the connecting pin extends transverse to the axis of the cylinder rod for movement in the elongate slot as the cylinder rod retracts and extends.

According to another embodiment of the invention, a method of temporarily retaining a side-secured discharge spout bulk bag in a closed position against a side of the bag during release of a closure tie from the bag spout is provided, and includes the steps of providing a bag tie retainer apparatus for a bulk bag discharger of the type wherein a frame suspends a bulk bag with a side-secured discharge. A bag-engaging member is mounted on the frame in a position laterally-displaced from a lower end of the bag above the discharge spout. The bag is moved between a retracted position out of engagement with the lower end of the bag and an extended bag engaging position for engaging and holding the bag spout in a closed position against the side of the bag during release of the tie from its position around the spout.

According to another embodiment of the invention, the step of moving the bag-engaging member comprises the step of moving a paddle.

BRIEF DESCRIPTION OF THE DRAWING

The present invention is better understood when the following detailed description of the invention is read with reference to the accompanying drawings, in which.

DETAILED DESCRIPTION OF THE PREFERRED EMBODIMENT AND BEST MODE

Figure 1:
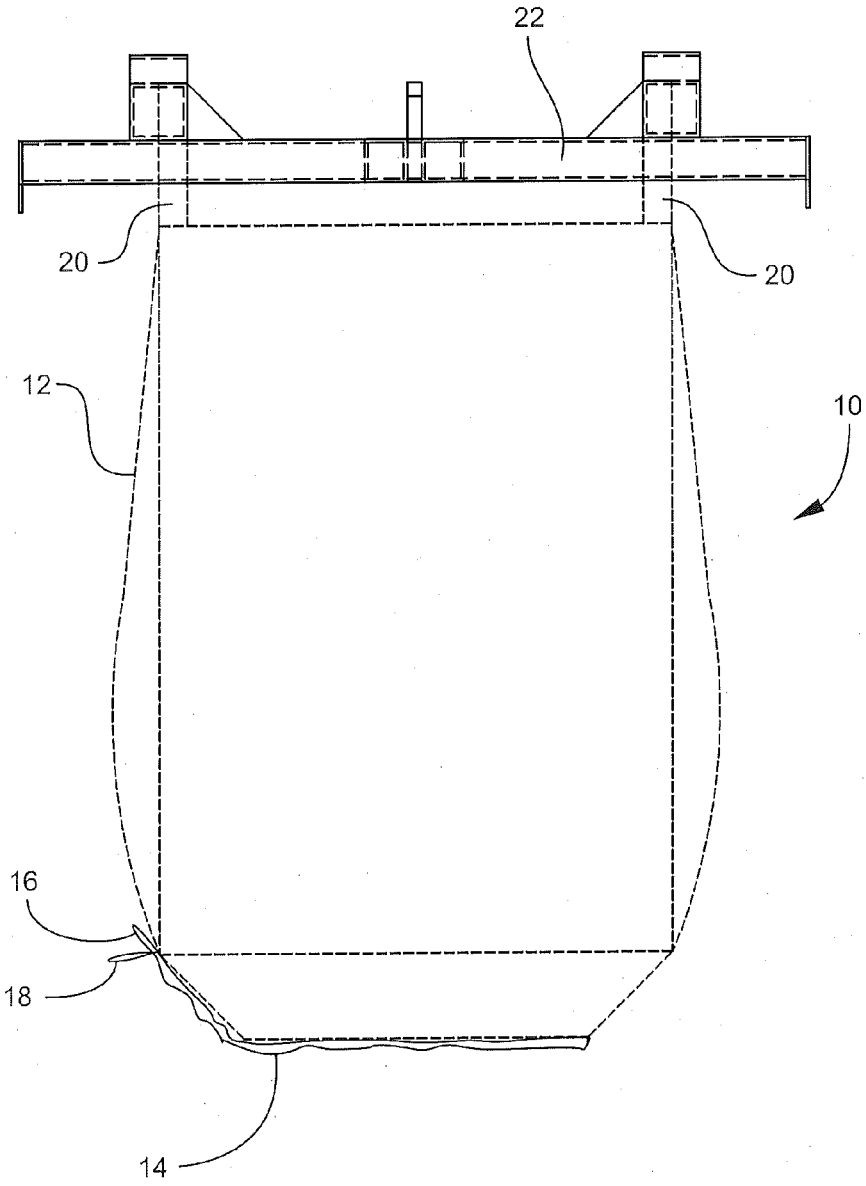
FIG. 1 is a side elevation view of a typical bulk bag with a bottom closure spout, with the spout folded into a closed position and tied against the side of the bag.
Figure 2:
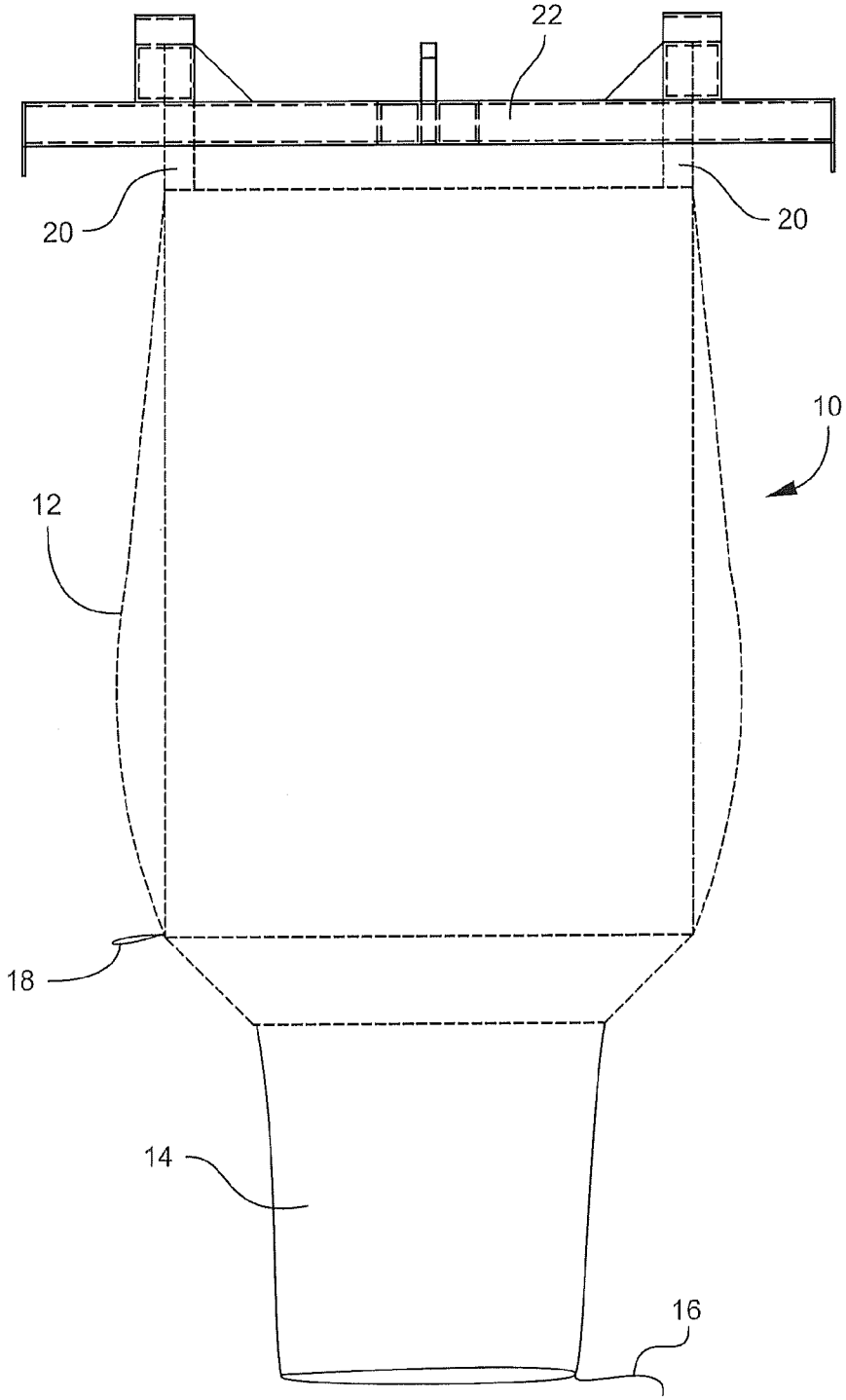
FIG. 2 is a side elevation of the bulk bag of FIG. 1 in its open, discharge position.

Referring now to the drawings, a typical bulk bag 10 with a side secured spout closure is illustrated in FIGS. 1 and 2, and includes a bag body 12, that is provided with a discharge spout 14 with a tie string 16 that is secured to a loop 18 on the side of the bag body 12 to hold the spout in its closed position, as shown in FIG. 1. The spout 14 is movable between a closed position as shown in FIG. 1 and the open position shown in FIG. 2. The bag 10 is lifted by lifting straps 20, shown in place on a lifting frame 22.

There are several different types of discharge closures with bottom flaps, including the closure of the type illustrated in FIGS. 1 and 2 wherein the discharge spout itself is folded across itself and secured to a side of the bag body 12 near the bottom to form a flap. All of these differing types are included within the use of the term "flap" as described in this application.

Figure 3:
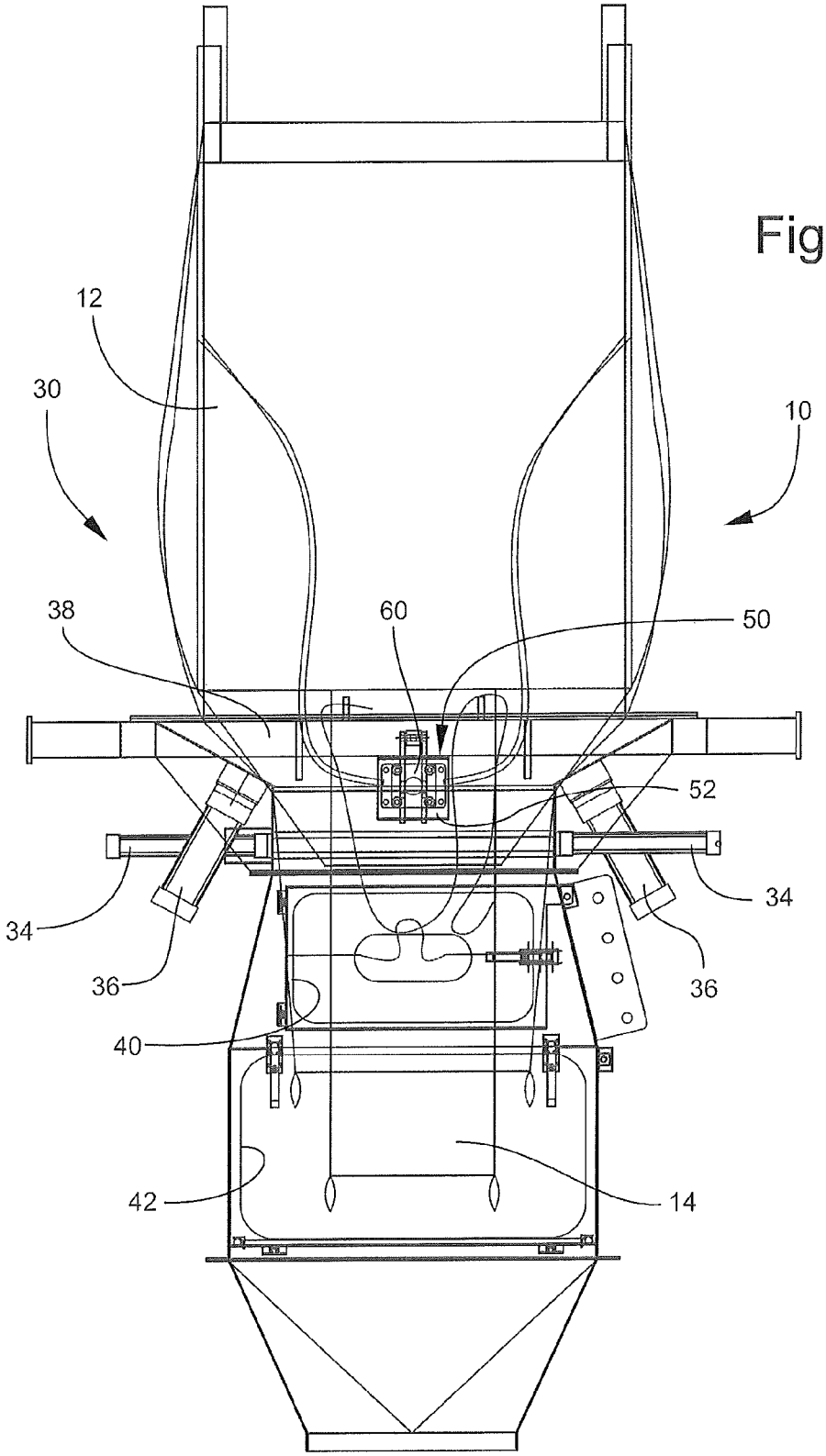
FIG. 3 is a side elevation of a bulk bag discharge assembly with a side-secured bag spout-type bag positioned in the bulk bag discharge assembly.

As is shown in FIG. 3, a frame assembly 30 includes a frame structure 32 that suspends and supports the bag 10. The frame assembly 30 may optionally include a pinch bar assembly 34 that permits flow control of the bag contents, and a massage assembly 36 that periodically pushes against the bottom and bottom sides of the bag 10 to loosen and encourage an even flow of the bag contents. The frame also includes a support dish 38 that centers and restrains the position of the bag 10. A rubber skirt (not shown) may additionally be positioned around the bottom of the bag to reduce dispersion of the bag contents. A bag spout access door 40 permits access to the area where the bag spout 14 is positioned, and a sack tip access door 42 provides access to the discharge opening area of the spout 14.

Figures 4, 4A:
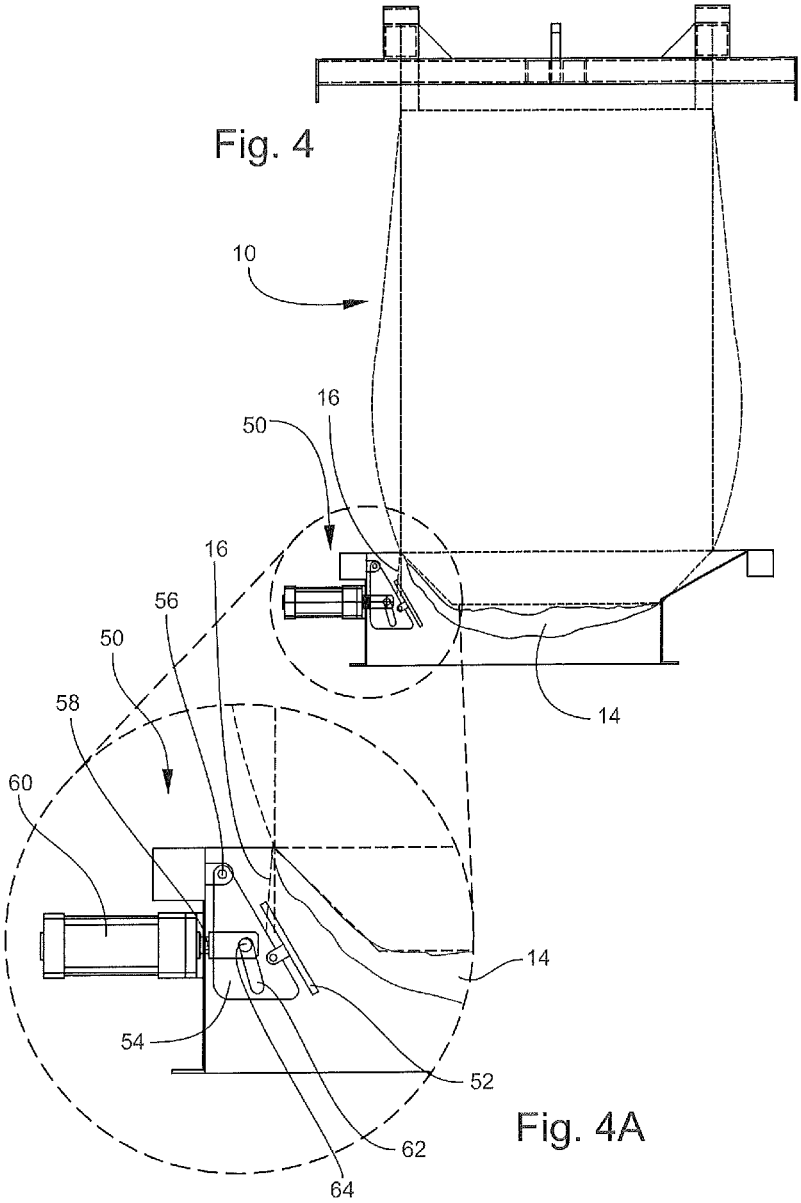
FIG. 4 is a simplified, partial side elevation of the bulk bag discharge assembly with the bag tie retainer in its retracted position.
FIG. 4A is an enlarged partial view of the bag tie retainer shown in FIG. 3.

Referring now to FIGS. 4 and 4A, the bag tie retainer apparatus 50 according to a preferred embodiment of the invention is shown, and includes a bag-engaging member such as a paddle 52 mounted on the support dish 38 part of the frame assembly 30 in a position laterally-displaced from a lower end of the bag 10 above the discharge spout 14. The paddle 52 is mounted on a paddle bracket 54 that is pivoted at its top end by a pivot pin 56 and moved to and away from the bag 10 by a cylinder rod 58 of a pneumatic cylinder 60. The operation of the pneumatic cylinder 60 is manually operated by a pneumatic switch, not shown.

The paddle bracket 54 includes an angled slot 62 which rides a connecting pin 64. As the paddle 52 is driven by the pneumatic cylinder 60 forward onto the surface of the bag 10, the connecting pin 64 is driven downwardly in the slot 62, causing the paddle 52 to rotate counterclockwise into a flush engagement with the bag 10. See FIGS. 5 and 5A. The paddle 52 attached to the bracket 62 is free to pivot through an angle constrained by the bracket 62. This additional pivot allows the paddle 52 to seat itself against the spout 14. This is necessary due to bag and bag location variations.

Figures 5, 5A:
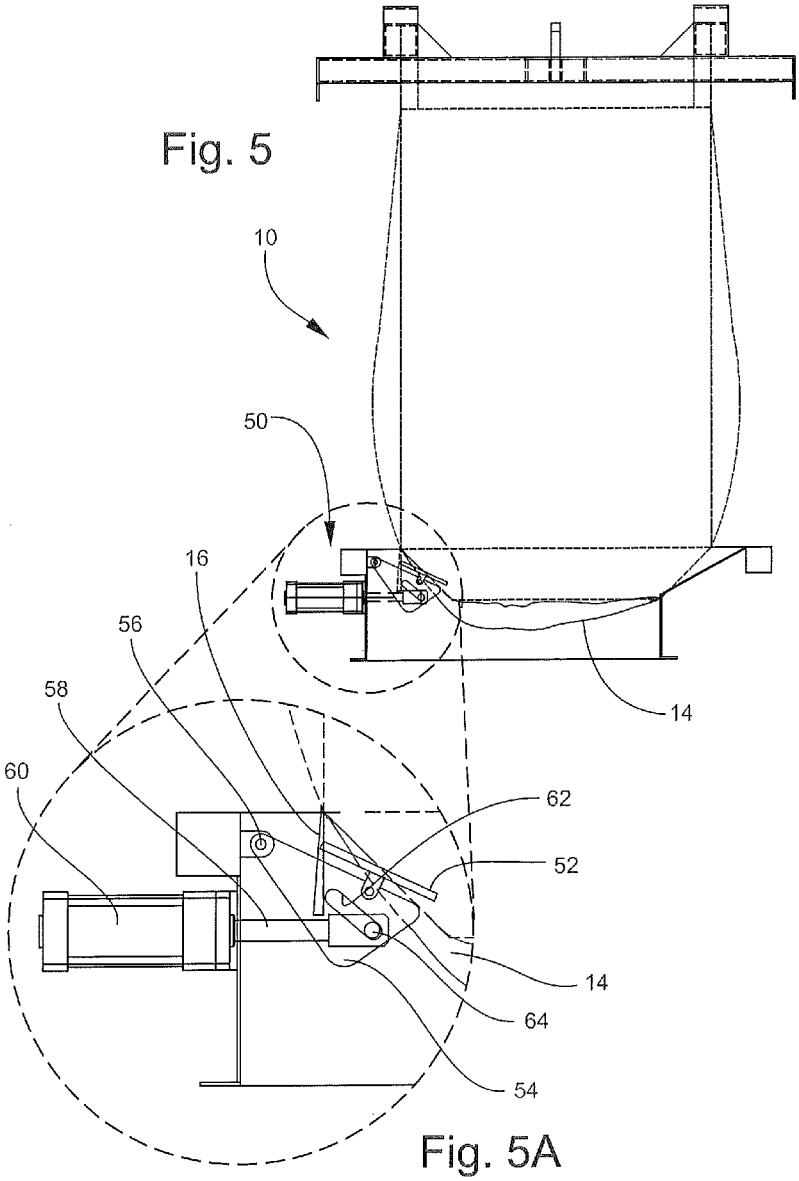
FIG. 5 is a simplified, partial side elevation of the bulk bag discharge assembly with the bag tie retainer in its extended bag engaging position.
FIG. 5A is an enlarged partial view of the bag tie retainer shown in the position of FIG. 4.
Figures 6, 6A:
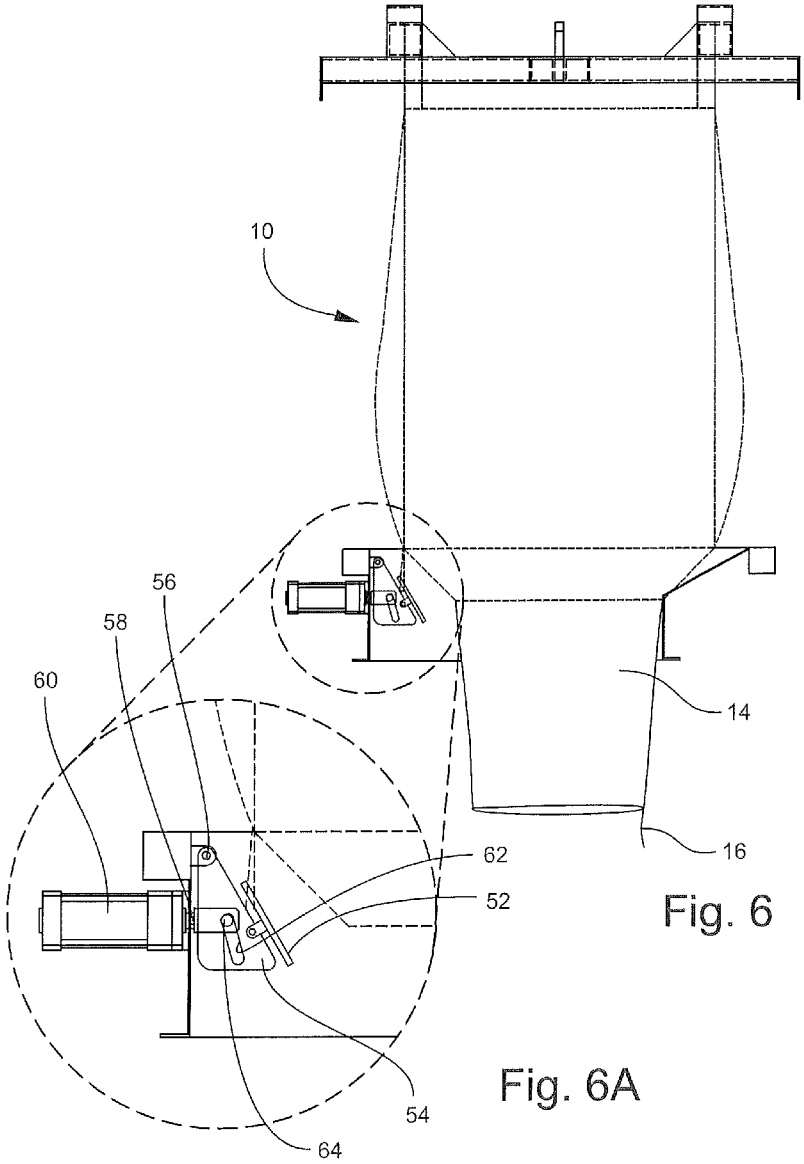
FIG. 6 is a simplified, partial side elevation of the bulk bag discharge assembly with the bag tie retainer in its retracted release position.
FIG. 6A is an enlarged partial view of the bag tie retainer in the position shown in FIG. 5.

By continued reference to FIGS. 5 and 5A, the paddle 52 is shown to be pressed slightly into the surface of the bag 10, trapping the spout 14 against the side of the bag 10. With the spout 14 trapped in this position, the tie string 16 can be loosened from the loop 18 by the operator without the spout 14 falling open, allowing the contents to spill. The operator can then move away from the bag 10 and into a safe area. When desired, the pneumatic cylinder 60 retracts the paddle, as shown in FIGS. 6 and 6A, allowing the spout 14 to fall open and the contents to begin flowing.

A discharger for side-secured bag spout and method are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

The invention claimed is:

1. A bag spout retainer apparatus for a bulk bag discharger of the type wherein a frame suspends a flexible bulk bag in an inverted condition with a bottom-emptying side-secured discharge spout, and further wherein the spout is held in a closed position against the bag by a releasable tie, comprising:

(a) a bag-engaging member mounted on the frame in a position laterally-displaced from a lower end of the bag above the discharge spout;

(b) a single bracket carried by the frame;

(c) a single paddle mounted on the bracket; and (d) a reciprocating driver attached to the bag-engaging member adapted for and moving the bag-engaging member between an extended, stationary bag engaging position for engaging and temporarily holding the bag spout in a closed position asymmetrically against the side of the bag after release of the tie and prior to release of the spout from the side of the bag, and upon release of the tie, moving to a retracted position out of engagement with the lower end of the inverted bag to permit contents to flow from the bag.

2. A bag spout retainer apparatus according to claim 1, wherein the single paddle is pivotally mounted on the single bracket, and further wherein the driver comprises a pneumatic cylinder.

3. A bag spout retainer apparatus according to claim 2, wherein the pneumatic cylinder includes a cylinder rod having connecting pin on a distal end thereof mounted in an elongate slot in the single bracket and oriented to move the single paddle upwardly and inwardly into contact with the bag and outwardly and downwardly away from the bag.

4. A bag retainer apparatus for a bulk bag discharger of the type wherein a frame suspends a flexible bulk bag with a side-secured, bottom-emptying discharge spout in an inverted condition, and further wherein a releasable tie attached to one or the other of the spout or the side of the bag holds the spout in its closed position against the bag, comprising:

(a) a single bracket on which is carried a single bag-engaging paddle pivotally mounted on the frame in a position laterally-displaced from a lower end of the bag above the discharge spout; and (b) a reciprocating power cylinder carried by the frame, attached to the bag-engaging paddle and adapted for moving the bag-engaging paddle between an extended bag engaging position for engaging and holding the bag spout asymmetrically in a closed position against the side of the bag before and during release of the tie from its position holding the spout the spout against the bag, the power cylinder including a connecting pin mounted in an elongate slot in the bracket oriented to move the paddle upwardly and inwardly into contact with the bag and outwardly and downwardly away from the bag, and upon release of the tie, moving to a retracted position out of engagement with the lower end of the inverted bag to permit contents to flow from the bag.

5. A bag spout retainer apparatus according to claim 4, wherein the single bracket includes a connecting pin carried by and extending transverse to the axis of the cylinder rod for movement in the elongate slot as the cylinder rod retracts and extends.

6. A method of temporarily retaining a flexible side-secured bottom opening discharge spout bulk bag in a closed position asymmetrically against a side of the bag during release of a bag spout from a closed position against the bag by releasing a tie from around the discharge spout, comprising the steps of:

(a) providing a bag retainer apparatus for a bulk bag discharger of the type wherein a frame suspends a bulk bag with a side-secured discharge;

(b) mounting a single bag-engaging member on the frame in a position laterally-displaced from a lower end of the bag above the bottom opening discharge spout; and (c) moving the single bag-engaging member between a retracted position out of engagement with the lower end of the bag and an extended, stationary, bag engaging position for engaging and temporarily holding the bottom opening bag spout in a closed position against the side of the bag after release of the tie and prior to release of the spout from its closed position against the bag.

7. A method according to claim 6, wherein the step of moving the single bag-engaging member comprises the step of moving a single paddle.

* * * * *